US008011346B2

(12) United States Patent
Blount

(10) Patent No.: US 8,011,346 B2
(45) Date of Patent: Sep. 6, 2011

(54) ROTARY COMPRESSED GAS ENGINE WITH PISTONS

(76) Inventor: David H. Blount, San Diego, CA (US)

( * ) Notice: Subject to any disclaimer, the term of this patent is extended or adjusted under 35 U.S.C. 154(b) by 357 days.

(21) Appl. No.: 12/455,151

(22) Filed: May 29, 2009

(65) Prior Publication Data

US 2010/0300401 A1 Dec. 2, 2010

(51) Int. Cl.
*F02B 53/00* (2006.01)

(52) U.S. Cl. ..... 123/245; 123/44 D; 123/44 E

(58) Field of Classification Search ..... 123/44 D, 123/44 E, 44 C, 245
See application file for complete search history.

(56) References Cited

U.S. PATENT DOCUMENTS

| | | | | |
|---|---|---|---|---|
| 3,581,718 | A * | 6/1971 | Petty | 123/44 R |
| 3,922,118 | A * | 11/1975 | Bancroft | 418/37 |
| 4,038,949 | A * | 8/1977 | Farris | 123/44 D |
| 4,137,891 | A * | 2/1979 | Dalrymple | 123/245 |
| 5,024,192 | A * | 6/1991 | Pomar | 123/245 |
| 5,671,702 | A * | 9/1997 | Lindblad | 123/44 D |
| 6,167,850 | B1 * | 1/2001 | Blount | 123/44 D |
| 7,469,673 | B2 * | 12/2008 | Wagner | 123/241 |
| 2009/0194065 | A1 * | 8/2009 | Okamura | 123/245 |

* cited by examiner

*Primary Examiner* — Thanh Lam

(57) ABSTRACT

This invention relates to an apparatus for producing a rotary motion force by means of a compressed gas rotary engine, rotary type with pistons in the circular rotor, consisting of a housing, a rotor with cylinder chambers containing pistons that has a rod containing a bearing which rotates against a stationary cam, the rotor is connected to a shaft, and combined with a r rod guiding system This engine may be produced in any suitable size and contain as many pistons as needed. More than one engine may be attached together. The engine has many uses such as to power machinery, automobiles, motorcycles, boats, generators, etc.

18 Claims, 16 Drawing Sheets

ROTARY COMPRESSED GAS ENGINE WITH PISTONS

BACKGROUND OF THE INVENTION

This invention relates to an apparatus for producing a rotary motion force by means of a compressed gas engine of the rotary type with pistons, provided with a rotor which has a circular shape and contains pistons which reciprocate in the rotor. The rotor is rotary mounded on a centrally located engine shaft in a fixed housing having a cavity formed by a circular peripheral inner wall and two side walls. The pistons are reciprocally mounted in a cylinder in the rotor and reciprocation of the pistons are guided by a fixed piston guide plate on the piston's rod and the rotor is rotated by the piston rod putting pressure on the stationary cam.

Many rotary engine have been invented in the past such as the James Watt rotary steam engine, Gilbert's engine, Cooley's engine, Selwood engine, Wankel's engine, Walter's engine, Farwell's engine, Mercer engine, Porsche rotary engines, Virmel engine, Kauertz engine, Geiger engine, Franke engine, Blount's engines and others but all of these are different than the engine of this invention.

The improved engine of this invention is of the novel rotary type engine powered by means of a compressed gas. This novel compressed gas rotary engine with pistons reciprocating in the rotor as the rotor rotates, and the pistons reciprocal motions are guided by piston guide plates on each side of the piston rod and slots in the piston which reciprocates over the shaft thereby keeping the piston from rotating. The engine of this invention is entirely different from Blount's U.S. Pat. No. 6,167,850 which is a combustion engine where as the engine in this invention is powered by compressed gas and has longer power stroke of 180 degrees compared to a 90 degree power stroke in Blount's U.S. Pat. No. 6,167,850 rotary engine. In this invention's rotary engine the eccentric stationary cam is round and improves the power and smoothness of the rotation of rotor. The engines of this invention has only two strokes, a expansion (power) stroke produced by compressed gas and an exhaustion stroke. It can not utilized as combustion engine because it does not have a suction stroke or compression stroke and it does not need a cooling system. The improvements of this compressed air rotary engine over Blount's U.S. Pat. No. 6,167,840 are:

1. Utilizes a compressed gas which can be re-used instead of a combustion mixture thereby producing no toxic gases;

2. Has only 2 strokes, expansion and exhaustion instead of 4 strokes, suction, compression, ignition and exhaustion;

3. Has a longer power (expansion) stroke of 180 degrees instead of 90 degrees;

4. This engine is much simpler to manufacture, simple in construction because it doesn't require any carburetor or fuel injection system, cooling system or compression system and lighter material may be used in the construction of this engine:

5. The compressed gas can be captured and re-compressed and re-used.

7. The compressed gas can be produced by use of an electric compressor and not use any carbon products which produces carbon dioxide, nitrogen oxides, sulfur oxides or other toxic products 8. The stationary cam of this engine is eccentric and round rather than irregular shaped and give a more smoother rotation of the rotor and reciprocation of the pistons.

SUMMARY OF THE INVENTION

The objection of the present invention is to produce an improved rotary engine that doesn't require any combustion products. Another object is to provide a novel apparatus which is a rotary engine powered by a compressed gas that can be re-used and that can be compressed by an electric compressor. Another object is to provide a 2 stroke, expansion and exhaustion, engine. Another object is to provide an engine with a 180 degree expansion (power) stroke. Another object is to provide and engine that doesn't require any cooling, ignition or combustion fuel systems. Another object is to provide and engine with one or more cylinder chambers. Still another object is to produce multiple arrangement of the compressed gas rotary engine of this invention.

The basic compressed gas rotary engine with reciprocal pistons of this invention consists of stationary cylindrical housing with cylindrical inner walls, front and back side walls, circular rotor rotatable mounted in the housing on a centrally located round shaft and rotates with the shaft, rotor contains circular cylinder chambers for the reciprocating pistons which are reciprocally guided by a piston guide plate and slots in the lower portion of the piston which reciprocates over the shaft. The rotor has a centrally located chamber to house the stationary cam and oil chamber. The rotor contains expansion chambers (cylinder chambers) above the pistons which are sealed off by means of seals on the rotor and rings on the pistons. The rotor is attached to the shaft and rotates with the centrally located shaft. The round shaft extends through the center of the side walls. The cylinder chambers volume vary in size when the rotor rotates and the pistons reciprocate thereby the strokes of expansion and exhaustion takes place in the cylinder chambers.

The apparatus of this invention is relatively simple in construction and operation whereby the engine can be produced at relatively low cost. Fewer parts are required in its construction when compared with conventional reciprocal engines. This new engine design improves the efficiency of the rotary engine operation, gives a longer piston power stroke, doesn't give off any undesirable exhaust fumes or carbon dioxide, carbon monoxide, nitrogen oxides and is extremely desirable. The rotor acts as a fly wheel but an addition fly wheel may be attached to the shaft. Two or more of the compressed gas rotary engines of this invention may be attached together.

The one, two or more cylinder rotary compressed gas powered engine of this invention consist of:

1. Housing, a stationary hollow cylindrical housing having a cylindrical inner peripheral wall which forms a circular cavity with room for a rotor to rotate, and has a front side wall and a rear side wall. The housing has passage way for admitting a compressed gas to the cylinder chamber and passage ways for discharging expanded compressed gases from the cylinder chamber.

2. rotor, a rotatable cylindrical rotor with a centrally located chamber and/or oil chamber and one or more cylinder chambers extending from the rotor's peripheral wall down to the centrally located central chamber and oil chamber, front and posterior wall with means for the posterior wall of the rotor to attach to the shaft and an opening in the center of the anterior wall of the rotor for the shaft pass through and cams stationary attachment to pass thru. The rotor has compression seals and oil seals to seal the cylinder chamber (expansion chamber) and central chamber from each other.

3. piston, a cylindrical piston which reciprocates in the cylinder chamber of the rotor, and has rings on the peripheral surface to seal the cylinder chamber from the centrally located central chamber containing the stationary cam, shaft and oil chamber. The piston has a piston rod containing a bearing located centrally on the bottom of the piston and has means to guide the reciprocal motions rotation of the piston and an to prevent the piston from rotating and to apply a force on the cylindrical stationary cam thereby forcing the rotor to rotate.

4. engine shaft, consisting of a round shaft which passes through the center of the housing walls and extends out the center of the front and posterior walls, and has means for the rotor to be attached to the shaft.

5. piston guide grove in the lower end of the piston and has means to fit over the shaft to prevent the piston from rotating 6. piston rod guide, consisting of two solid plate on the end of the piston rod and extends to each side of the cam, and has means to prevent the piston from rotating.

7. pressure gauge with means to regulate the pressure of the compressed gas before the gas enters the expansion chamber.

8. air valve with means to control timing and volume of compressed air that enters the expansion chamber.

9. Oil chamber with passages to lubricate the moving parts of the engine.

The basic engine components of the engine of this invention may be used in this compressed gas rotary engine which contains one or more compression chambers. The basic engine components may vary in size based on the size of the engine but the basic shape of the engine components remains the same.

The air valve to control the timing and volume of compressed gas may be of the mechanical type, magnetic type and electronic controlled type. A magnet may be attached to the shaft and the magnet waves are pickup by a pick-up coil and the magnet waves are magnified and utilized to open the air valve at the right time and for the desired length as illustrated in Blount's U.S. Pat. No. 5,734,943 and utilized in a fuel injection system.

Any suitable compressed gaseous material may be utilized to power the rotary engine of this invention but not limited to helium, hydrogen, nitrogen and air. Compressed air is the preferred gas. The gas may be compressed to 100 psi to 6000 psi or higher depending on the strength of the tank and the protection around the tank if it explodes. The pressure of the gas when it enters the cylinder chamber of this engine may be controlled by a pressure regulator. The amount of pressure of the gas entering the compression chamber will depend on the size of the engine, strength of the material of the engine and the rotors revolution desired. The amount of compressed gas that enters the cylinder chamber may be regulated by an air valve which controls the length of time that the gas is entering the cylinder chamber which allows the compressed gas to expand and exhaust at a lower psi thereby using less compressed gas. The expanded gas may be captured and kept to be re-compressed for further use.

DESCRIPTION OF THE DRAWINGS

Other object of the invention will become apparent upon reading the annexed detail description in connection with the drawing in which.

DESCRIPTION OF PREFERRED EMBODIMENT

Figure 1:
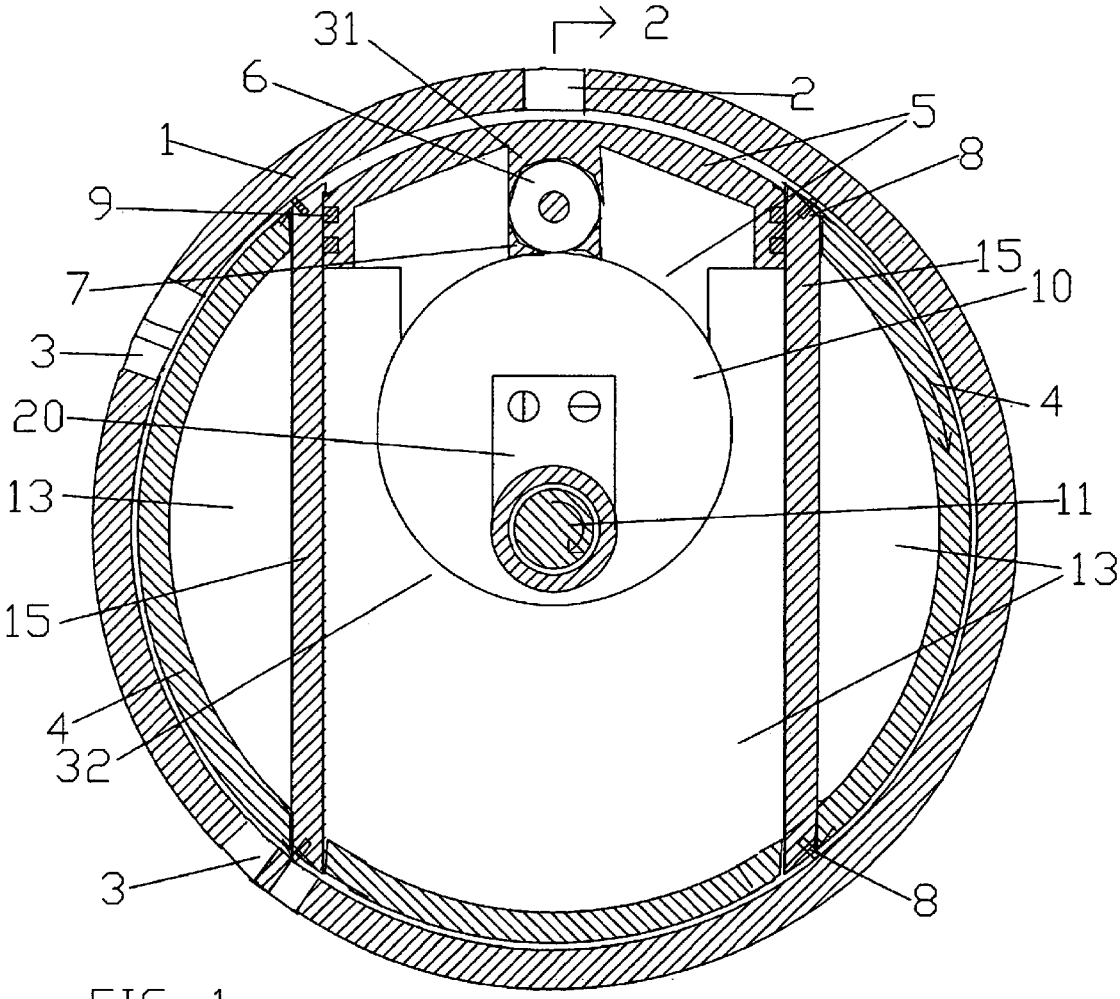
FIG. 1 is a cross sectional view of a 1 cylinder chamber, 1 piston, compressed gas rotary engine.
Figure 2:
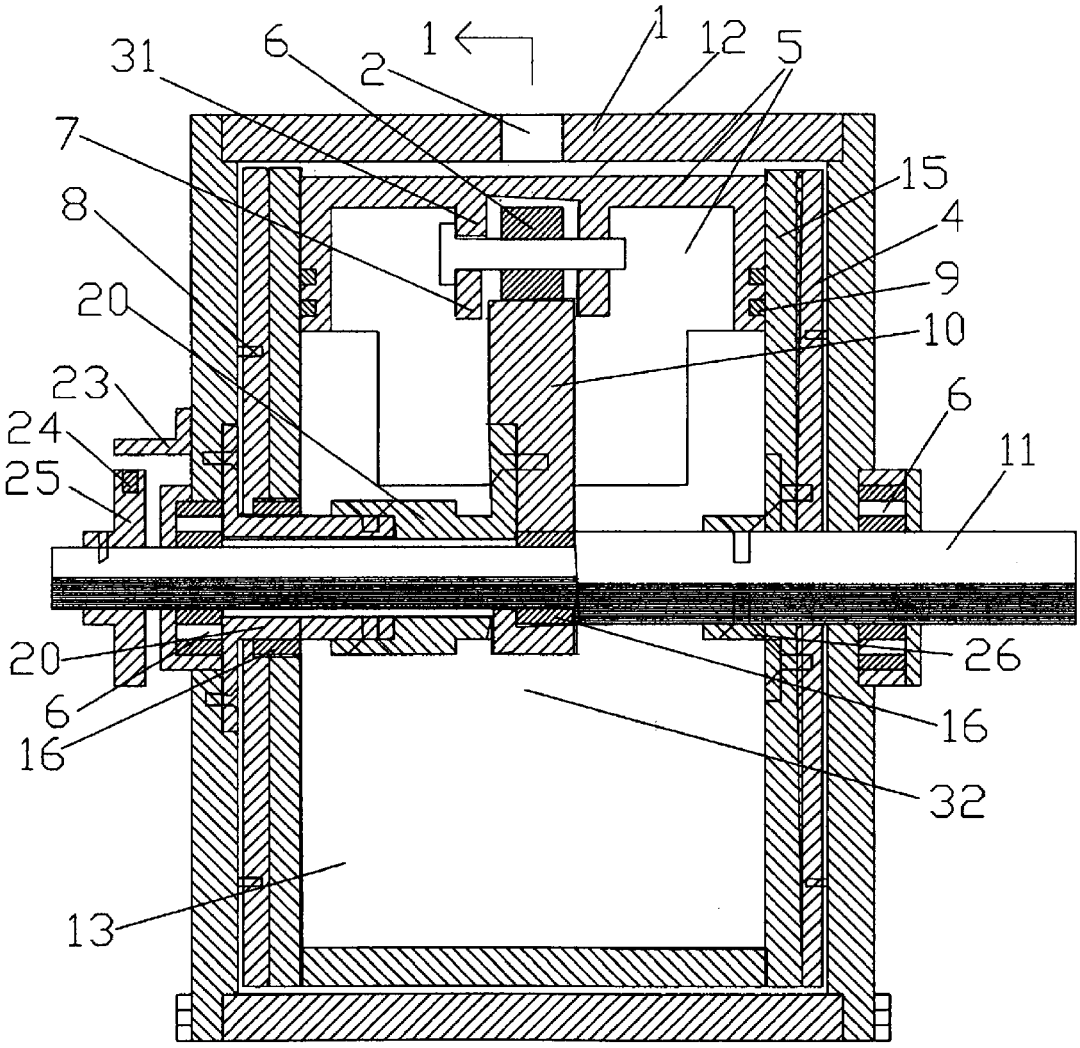
FIG. 2 is a sectional view of a 1 cylinder chamber, 1 piston, compressed gas rotary engine with a magnetic pick-up coil.
Figure 3:
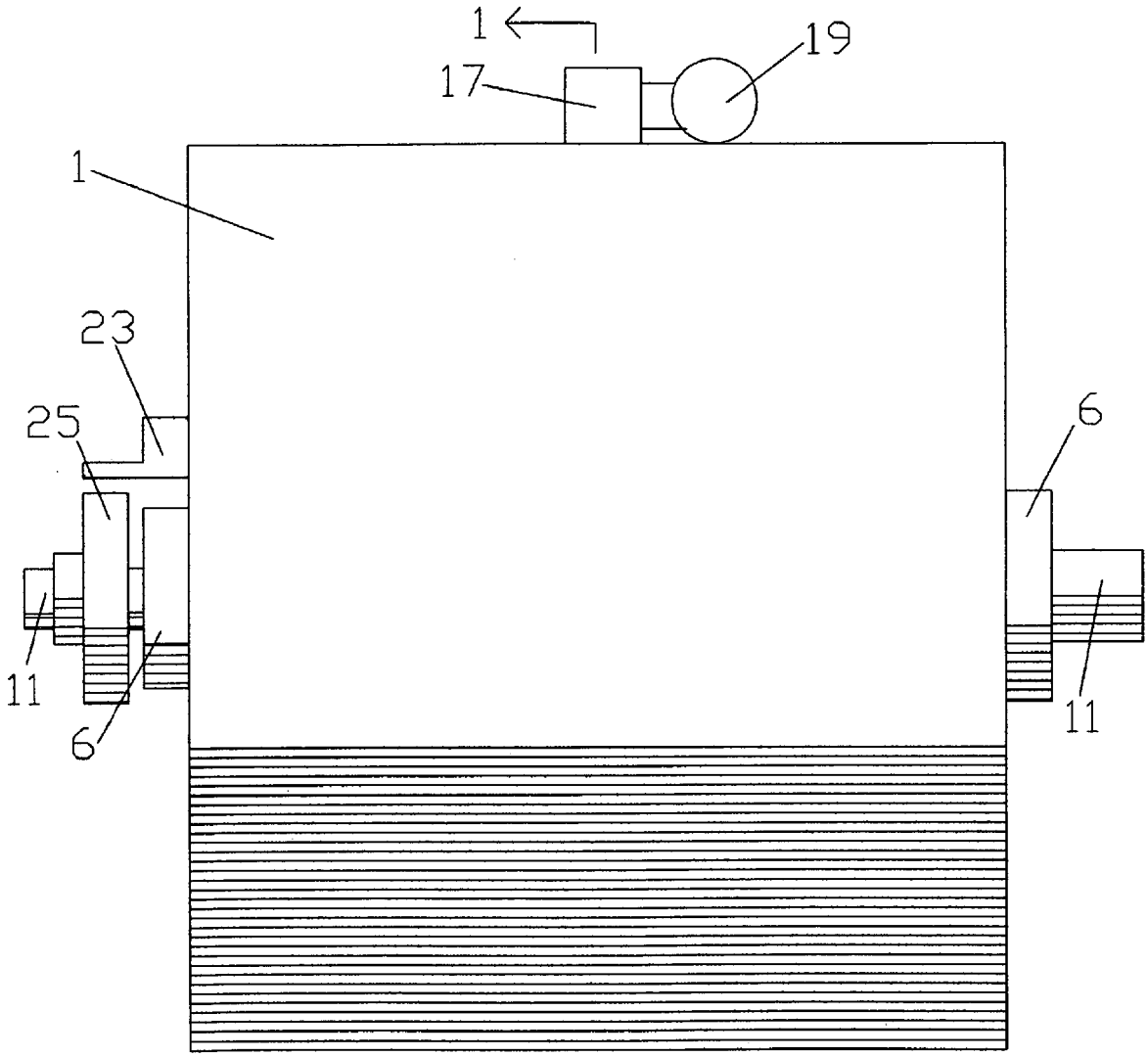
FIG. 3 is an exterior view of a 1 cylinder chamber, 1 piston, compressed gas rotary engine.

Referring to the drawings and in particular to FIG. 1, the compressed gas rotary engine with a reciprocal piston of the present invention includes a circular engine housing 1 which has a front side wall 22 and a rear side wall 21 attached to the housing 1 by bolts. The round engine shaft 11 extends out through the center of the front and rear side walls 22, 21 and is attached to the posterior rotor wall 21. The engine housing 1 of the compressed gas rotary engine has 2 exhaust ports 3 at about 225 degrees and 255 degrees and a compression air intake port 2, The stationary circular housing 1 contains a circular rotor 4 which rotates with the shaft 11 and it has a circular cylinder chamber 12 which is also the expansion chamber, seals 8 and which are also oil seals 8. Within the rotors cylinder chamber 12 is a circular piston 5 which reciprocates in the cylinder chamber 12 and rotates with the rotor 4. The peripheral area of the piston 5 has rings 9 to seal off the cylinder chamber 12 from the oil in the central chamber 13 and the central chamber 32. The piston 5 has a piston rod 31 which is also the piston guide 7 holds the bearing 6 and the piston guide rod extends on each side of the cam 10 to guide the piston around the cam 10 along with slots 7 in the bottom of the pistons which fits around the shaft 11 thereby preventing the piston 5 from rotating. The bearing 6 is held in place by a pin. The rod bearing 6 travels over a stationary round shape cam 10 and the inner rod guide 7 fits on each side of the cam 10 thereby guiding the reciprocal motion of the piston 5. Referring to FIG. 2 the compressed gas rotary engine is similar to FIG. 1 except that it also has a timing pulley 25 on the shaft 11 in front of the front wall 22 and above the timing pulley 25 there is a pick-up coil 23 for magnetic waves and it is attached to the front wall 22. FIG. 3 is the exterior plan for FIGS. 1 and 2 also has a timing pulley 25 attached to the shaft 11 in front, a magnetic pick-up coil 23 attached to the front wall 22, a magnetic air valve 17 attached to the compression gas intake 2 and a pressure regulator 19 attached to the magnetic air valve 17.

Figure 4:
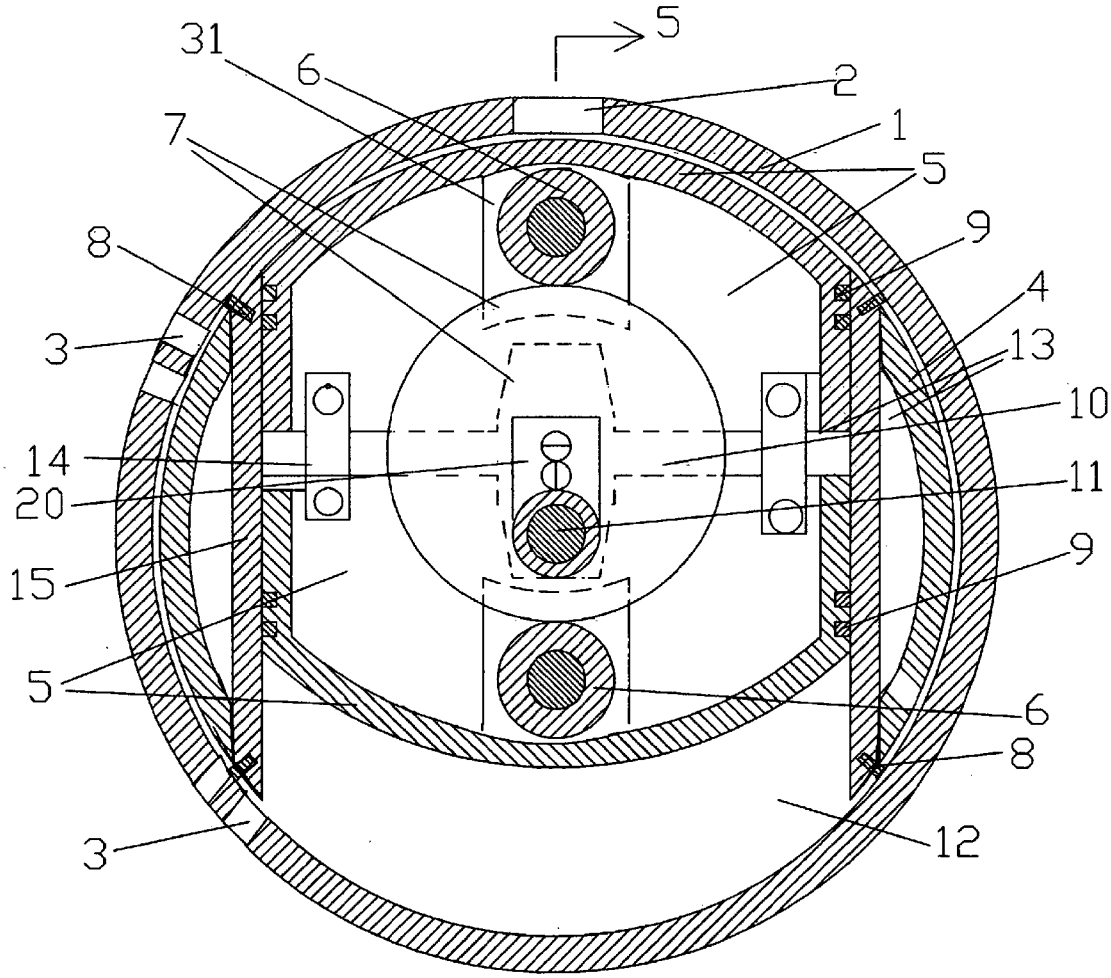
FIG. 4 is a cross sectional view of a 2 cylinder chambers, 2 piston compressed gas rotary engine.
Figure 5:
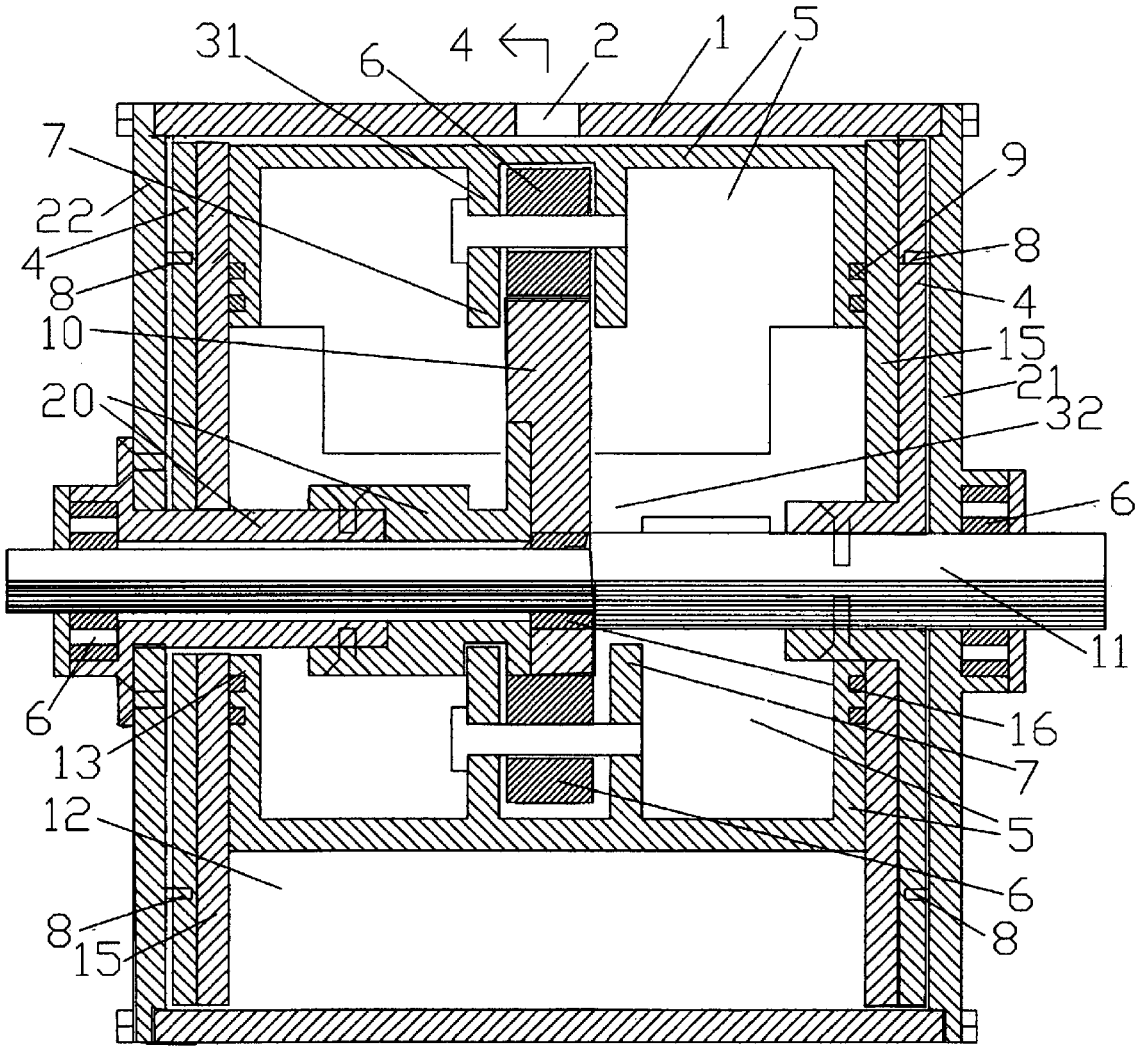
FIG. 5 is a sectional view of a 2 cylinder chambers, 2 piston, compressed gas rotary engine.
Figure 6:
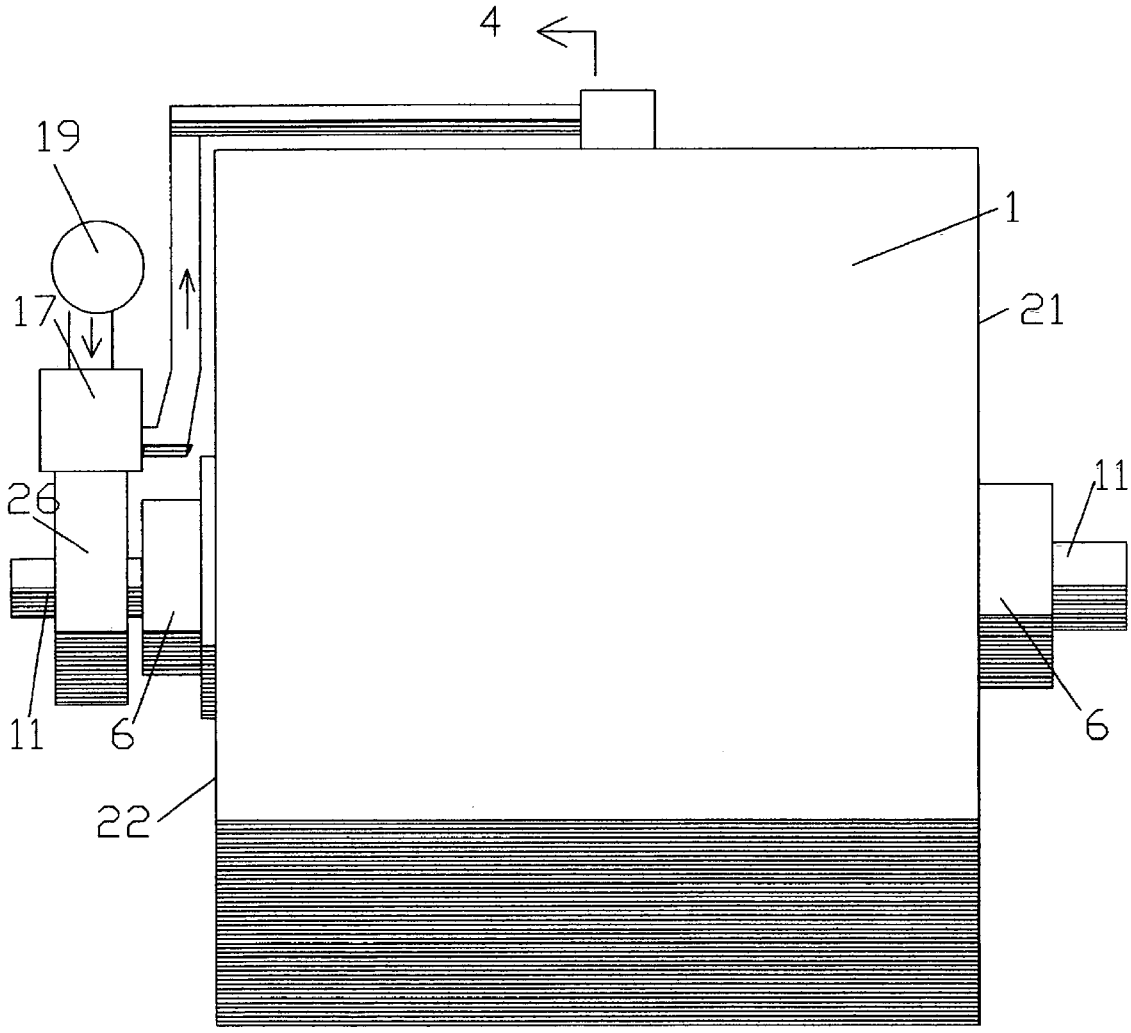
FIG. 6 is an external view of a 2 cylinder chambers, 2 piston, compressed gas rotary engine with a mechanical air valve.

FIG. 4, FIG. 5 and FIG. 6 which are plan of a compressed gas rotary engine with 2 cylinder chambers and 2 pistons 5 and they are similar to FIG. 1 except that the rotatable rotor 4 has two cylinder chambers 12 opposite each other and has two pistons 5 which has rings 9 and seals 8 on the rotor 4 to seal off the piston chambers 12 from oil in the central chamber 32 and to prevent the loss of compressed gas. The reciprocal motion of the pistons 5 in the cylinder chambers 12 are guided by the cam 11 and by piston guides 7 on the end of the piston rod 31, by slots 7 in the bottom of the piston 5 and by attaching the pistons 5 together with fasteners 14 which are attached to the bottom of the pistons 5 which keeps the two pistons 5 bearings 6 against the cam 10. FIG. 6 is a plan exterior of the compressed gas rotary engine of FIG. 4 And FIG. 5 which has a mechanical air valve 27 attached to the shaft in front of the engine with a pipe connected to the compressed gas intake 2 and a pressure gauge 19 to control the compressed gas pressure.

Figure 7:
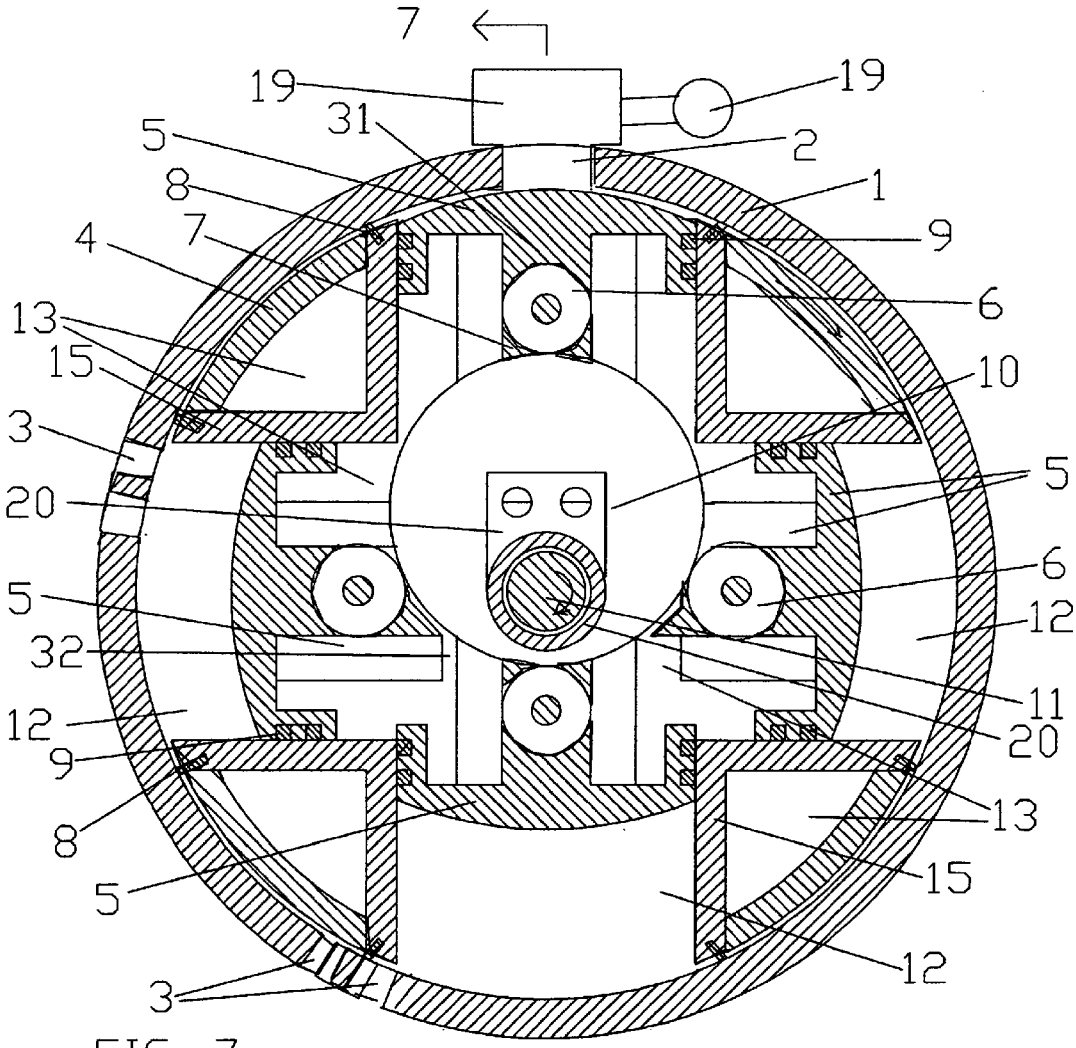
FIG. 7 is a cross sectional view of a 4 cylinder chambers, 4 piston, compressed gas rotary engine.
Figure 8:
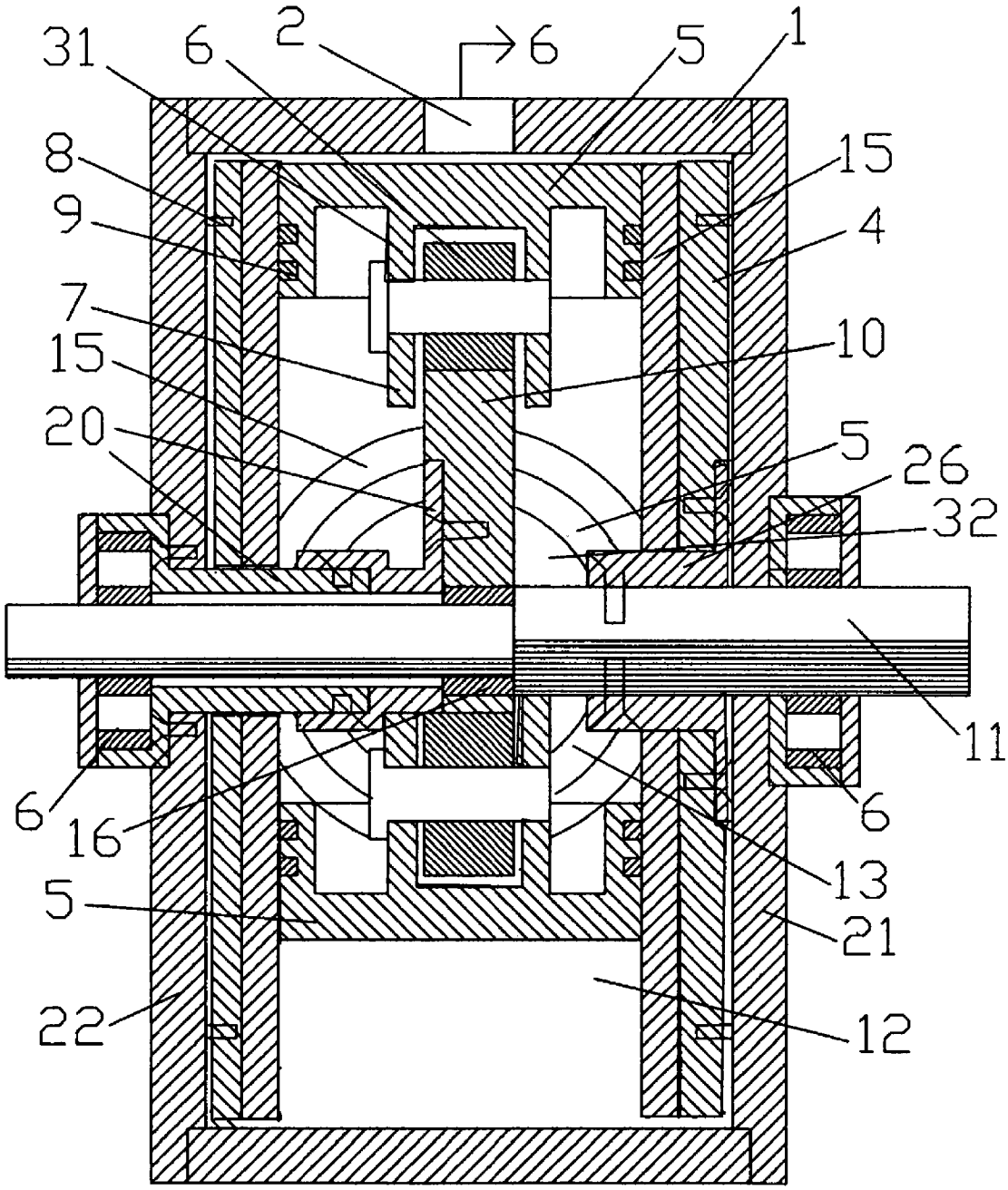
FIG. 8 is a sectional view of a 4 cylinder chamber, 4 piston, compressed gas rotary engine.
Figure 9:
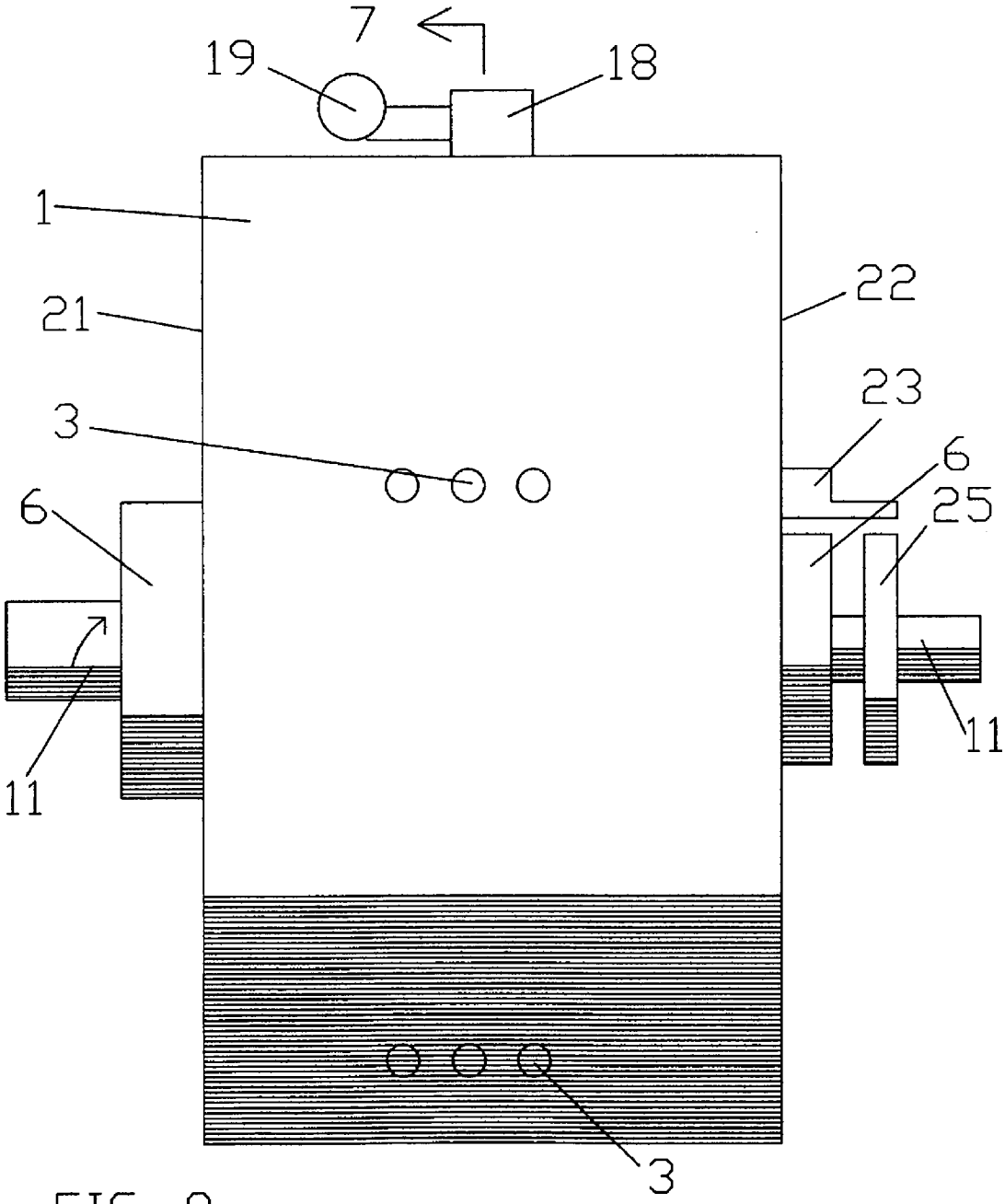
FIG. 9 is a plan exterior view of a 4 cylinder chambers, 4 piston, compressed gas rotary engine with a magnetic pick-up coil, magnetic air valve and a pressure regulator.

Referring FIG. 7, FIG. 8 and FIG. 9 which are plan drawings of a four cylinder compressed gas rotary engine of this invention which is similar to FIG. 4 except that the rotatable rotor 4 has cylinder chambers 12 at 90 degrees from each other and each piston 5 in the cylinder chambers 12 has rings 9 and rotor has seals 8 on the rotor 4 to seal off the central chamber and the oil 13 in the central chamber and to prevent the loss of compressed gas. The rotor has seals to seal off one cylinder chamber for another cylinder chamber, The reciprocal motion of the pistons 5 in the cylinder chambers 12 is guided by the piston guides 7 on the end of the piston rod 31 the slots 7 in the lower end of the piston and by the stationary round cam 10. The pistons 5 has a bearing 6 in the piston rod 31 which rotates on the stationary cam 10. The housing has a pressure gauge 19 attached to the compressed gas intake 2 and has two exhausts 3. FIG. 8 is plan sectional view of the 4 cylinder compressed gas rotary engine of this invention which has a stationary cam attachment 20 which is attached to the front wall 22 and has an attachment to the cam 10 and the rotor 4 has an attachment to the shaft 11 so that the rotor 4 will rotate with the shaft 11. FIG. 9 is an exterior view of the 4 cylinder compressed gas rotary engine of this invention wherein the housing 1 has a pressure regulator 19 and an electronic magnet air valve 18 attached to the compressed gas intake 2 and two exhaust ports 3 and a magnetic wave pick-up coil which pick up the magnetic wave from the magnet 24 on timing pulley 25 which is attached to the front end of the shaft 11. The shaft 11 extends out the front and back walls centrally and has bearings 6 on the front wall 22 and back wall 21.

Figure 10:
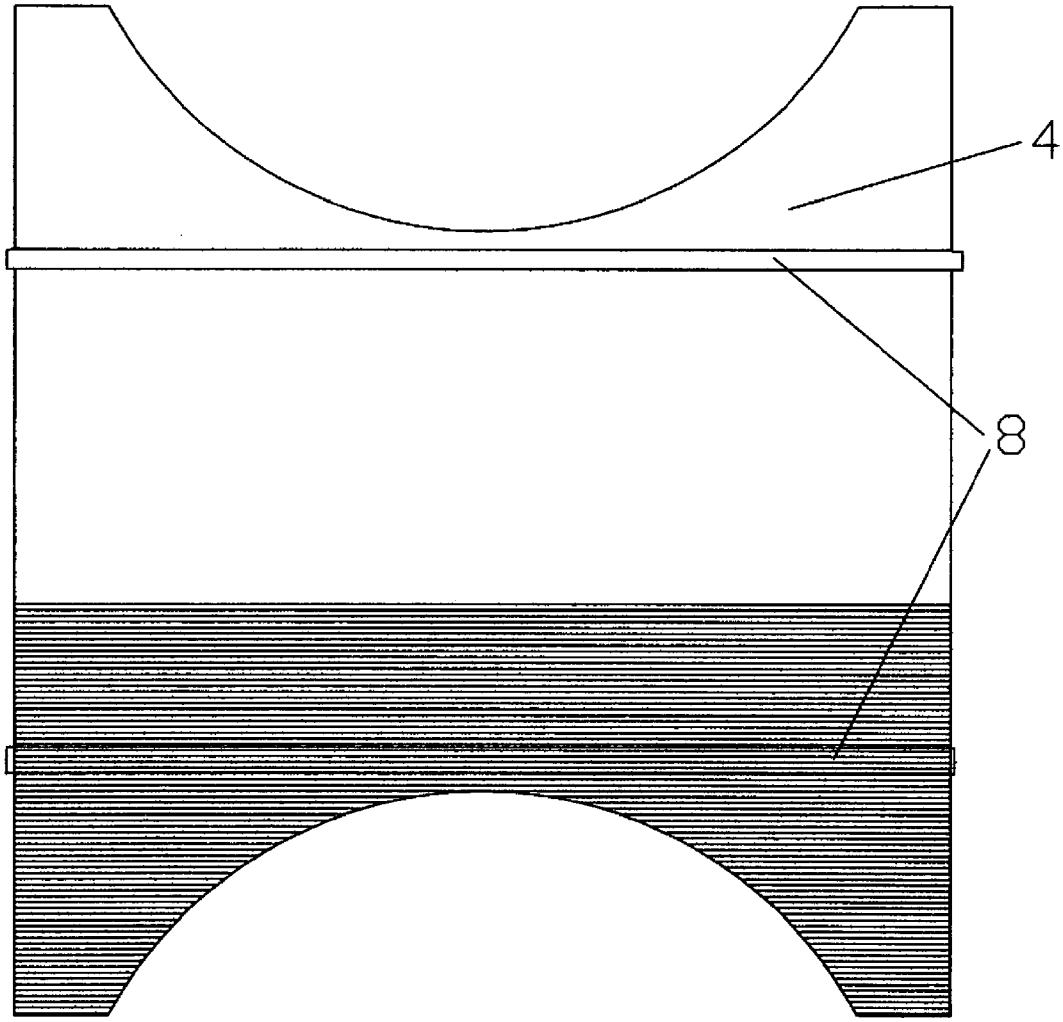
FIG. 10 is a plan exterior view of a rotor for this compressed gas rotary engine with cylinder chamber which can be utilized for one or two pistons.
Figure 11:
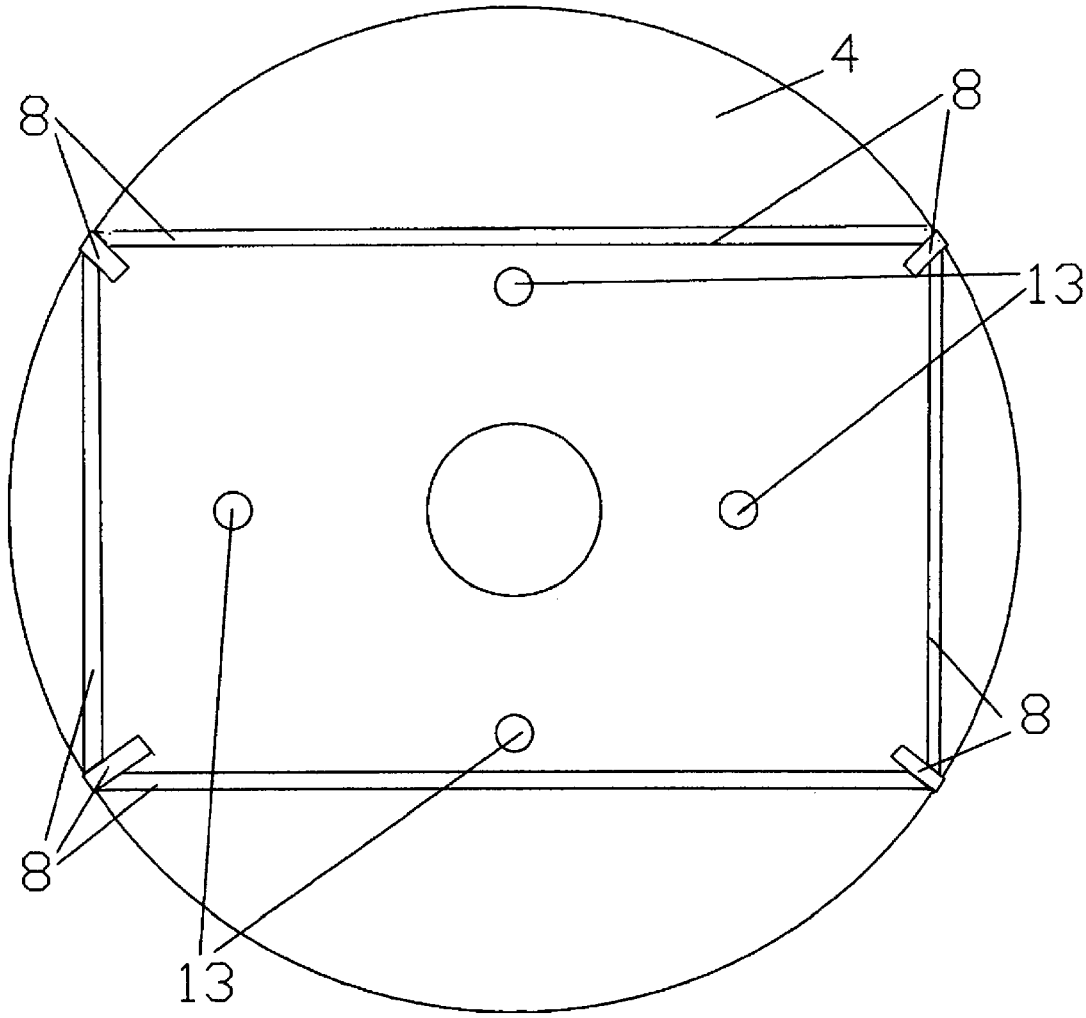
FIG. 11 is a plan exterior side view of the rotor for this compressed gas rotary engine showing the seals and piston guides.
Figure 12:
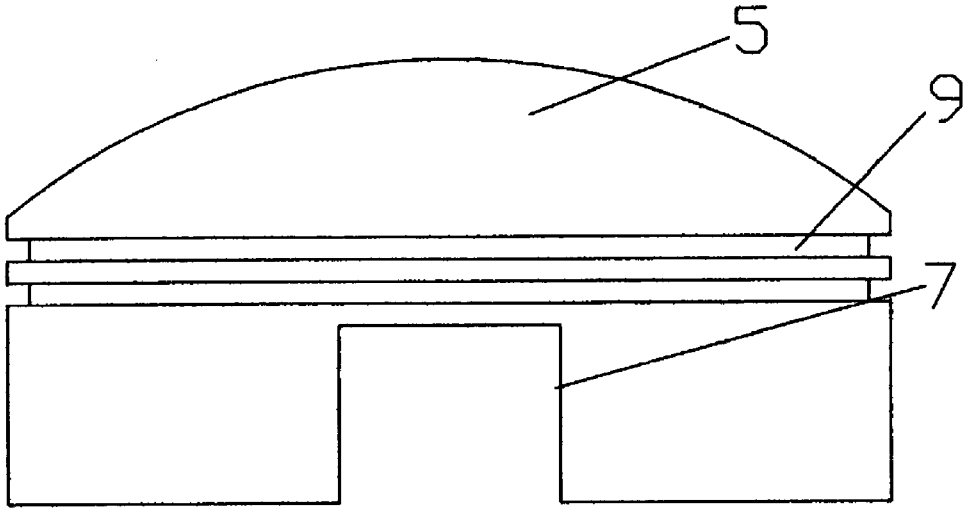
FIG. 12 is a plan exterior view of the piston for this compressed gas rotary engine showing the rings and piston guide slots.
Figure 13:
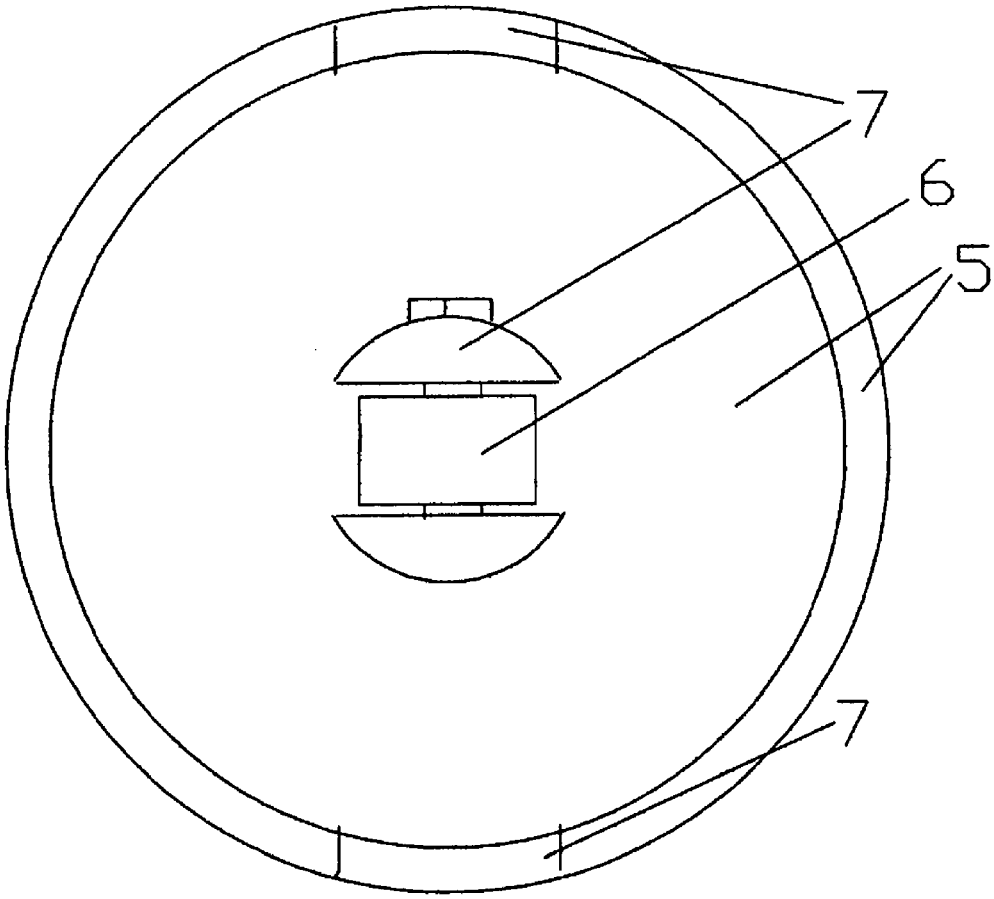
FIG. 13 is a plan exterior under view of the piston for this compressed gas rotary engine showing the bearing and piston guides.
Figure 14:
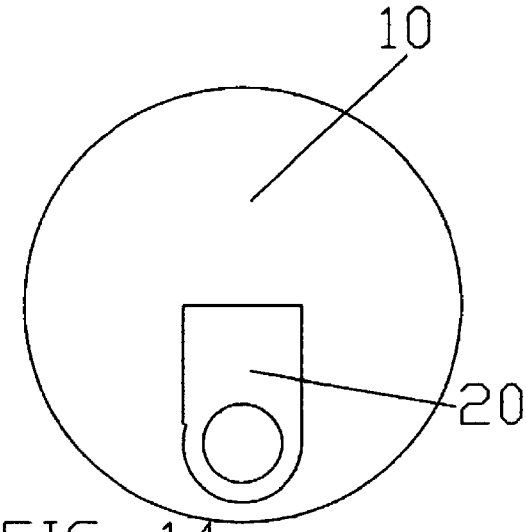
FIG. 14 is a plan exterior front view of the cam for this compressed gas rotary engine with its stationary attachment and hole for the shaft.
Figure 15:
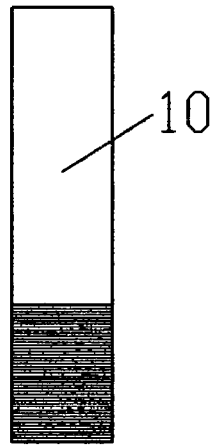
FIG. 15 is a plan side view of the cam for this compressed gas rotary engine.
Figure 16:
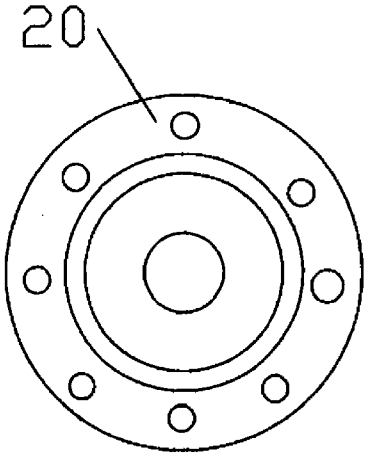
FIG. 16 is a plan view of the front of the cam stationary attachment to the front side panel of this compressed gas rotary engine.
Figure 17:
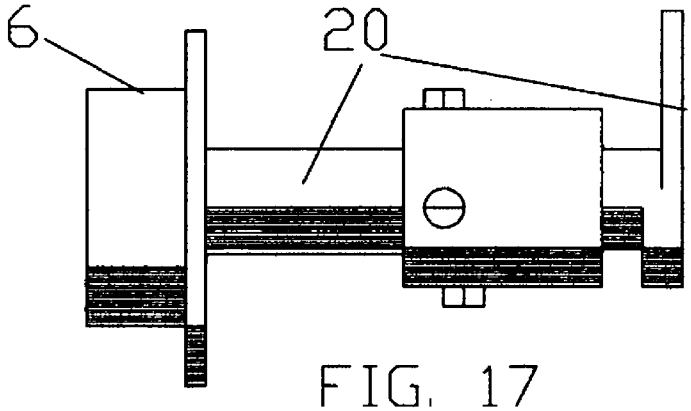
FIG. 17 is a side view of the stationary cam attachment to the cam and front side panel of this compressed gas rotary engine.

FIG. 10 thru FIG. 17 are plan views of the parts of this compressed gas rotary engine of this invention. FIG. 10 is an exterior view of the rotor 4 which is round and has seals and an open on top and bottom for the cylinder chambers 12. FIG. 11 is an external view of the side of the rotor 4 showing the seal 8 and holes to the oil chamber 13. FIG. 12 is and external view of the round piston 5 showing the ring 9 grooves and the piston guide 7 slot. FIG. 13 is a plan view of the bottom of the piston 5 and showing the piston rod 31 containing the piston guide 7 on the end of the piston rod, the piston guides 7 on the sides of the piston 5 and the bearing 6 in the center of the piston rod 31. FIG. 14 is a plan view of the front of the round cam 10 containing a slot for the cam's stationary attachment 20 and a hole for the shaft 11 to pass thru. FIG. 15 is the side view of the round stationary cam 10. FIG. 16 is a view of the end of the cam's stationary attachment 20 where it attaches to the front wall 22 and cam 10 contains a slot for the bearing 6 and has a hole for the shaft 11 to pass through. FIG. 17 is an external side view of the cam's stationary attachment 20 which is made into two parts to be able to remove the stationary cam 10.

Figure 18:
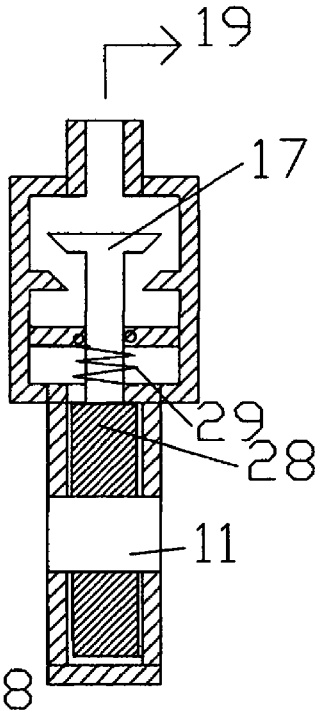
FIG. 18 is a plan sectional view of the mechanical air valve showing the valve cam and the air valve for this two cylinder compressed gas rotary engine.
Figure 19:
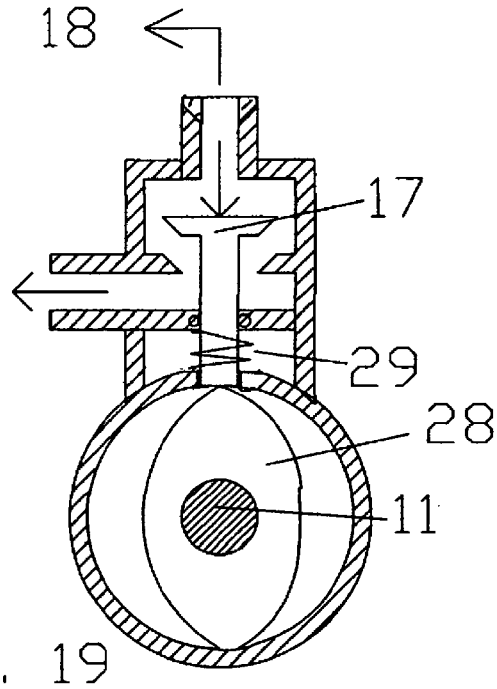
FIG. 19 is a plan cross sectional view of the mechanical air valve showing the valve cam and the air valve for this two cylinder compressed gas rotary engine.
Figure 20:
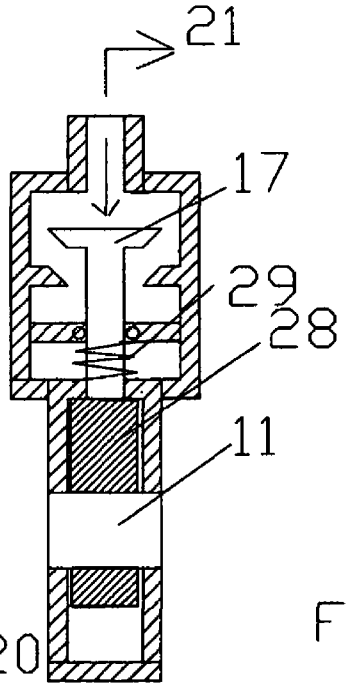
FIG. 20 is a plan sectional view of the mechanical air valve showing the valve cam and the air valve for a one cylinder compressed gas rotary engine.
Figure 21:
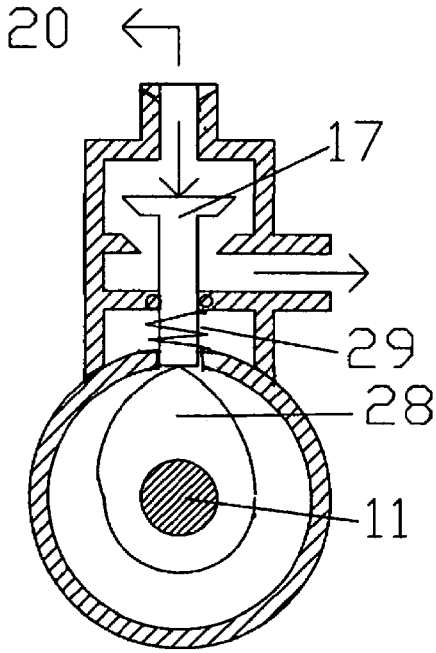
FIG. 21 is a plan cross sectional view of the mechanical air valve showing the valve cam and air valve for a one cylinder compressed gas rotary engine.
Figure 22:
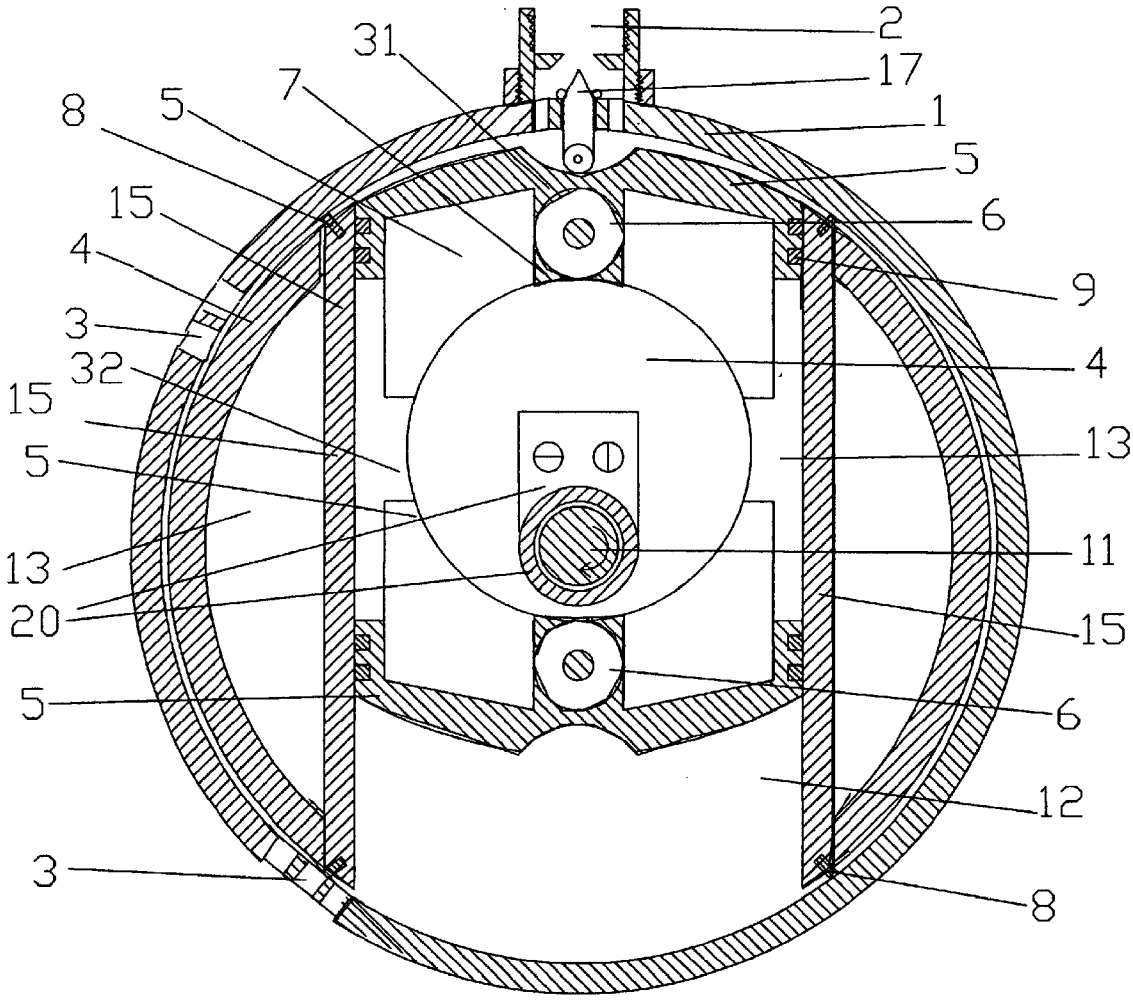
FIG. 22 is a plan cross sectional view of a 2 cylinder, 2 piston compressed gas rotary engine with a mechanical air valve.

FIG. 18 thru FIG. 21 are plan views of mechanical air valves. FIG. 18 is a plan sectional of a mechanical air valve illustrating the air valve 17, the spring 29 to close the air valve 17 and the air valve cam 28 opens and closes the air valve and is shaped for opening and closing the air valve twice per revolution. The air valve cam is attached to the shaft 11. FIG. 19 is a plan of a cross sectional view of an air valve for a two cylinder pressure gas rotary engine showing the compressed gas flow, the gas valve 17, the spring 29 for closing the air valve, the air valve cam which connected to the shaft 11 and rotates with the shaft. FIG. 20 is a plan sectional air valve for a one cylinder compressed gas rotary engine illustrating the air flow, showing the air valve 17, the spring 29 to close the air valve, the air valve cam 28 which is attached to the shaft 11. FIG. 21 is a plan cross sectional view of an air valve for a one cylinder compressed gas rotary engine showing the gas flow, the air valve 17, the spring 29 for closing the air valve, the air valve cam 28 which opens the air valve one time per rotation for a one cylinder compressed gas rotary engine and the air valve cam 28 is connected to the shaft 11. FIG. 22 is a cross section of a 2 cylinder chambers 12, 2 piston 5 in a rotor 4 which rotates inside the stationary housing 1, the housing 1 has a mechanical air valve attached to the compressed gas intake 2 which opens and closes by rotation of the rotor 4 and slot in the piston 5. FIG. 22 pistons 5 has rings for sealing the piston from the central chamber 32 an the rotor has seals 8 to seal the cylinder chambers from the other cylinder chambers 12 and the central chamber 32 and the piston 5 has a piston rod 31 which contains a bearing 6 and piston guides 7. The piston's bearing 6 is against the stationary cam 10 which is attached to cam stationary attachment which passes thru the center and front wall of the rotor 4 and is attached to the anterior wall 22 of the housing 1.

Figure 23:
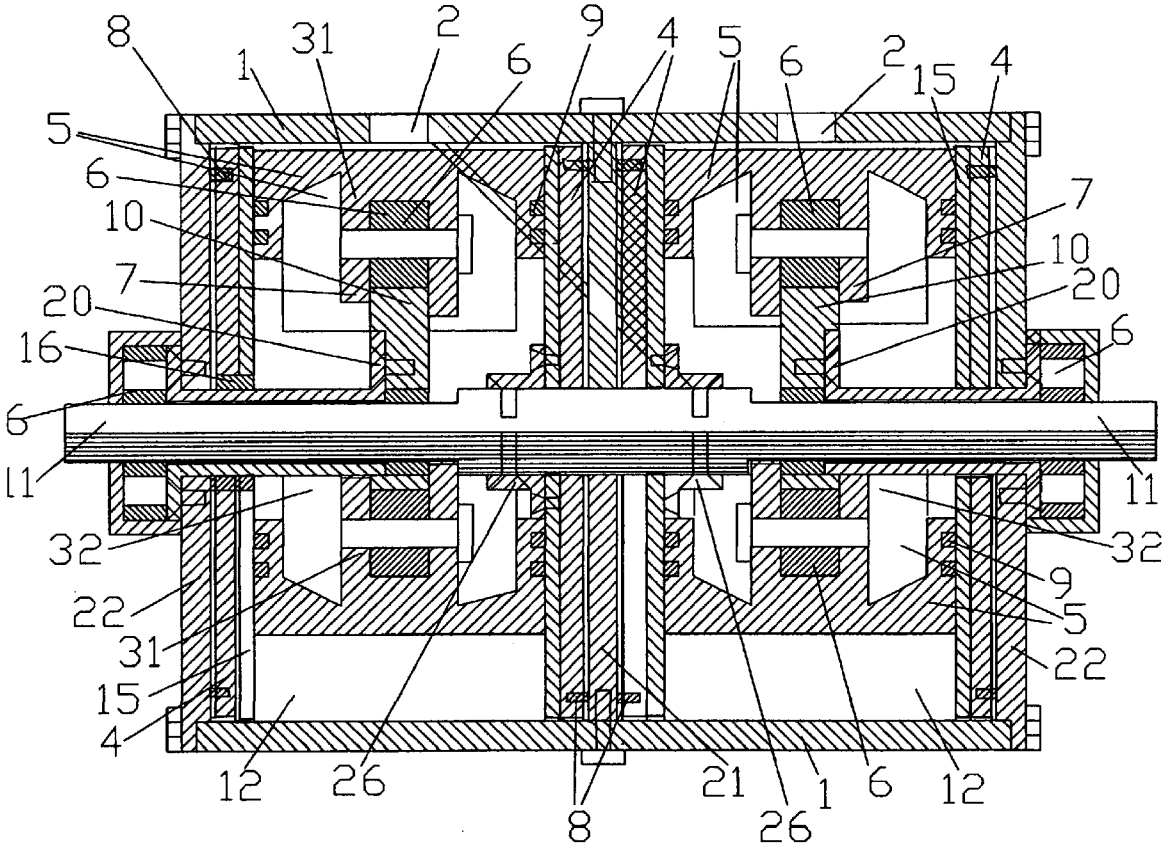
FIG. 23 is a plan sectional view of a double compressed gas rotary engine each containing 2 cylinder chambers.

FIG. 23 is a plan view of a double 2 cylinder compressed gas rotary engine which are two compressed gas 2 cylinder engines that is contained in the same housing 1 and has a posterior wall 21 separating the two engines. The two engine has the same parts and function the same as the engine of FIGS. 4,5 and 6. The cylinder chambers 12 with the minimum volume and with the piston 5 is under the compressed gas intake 2 are filled with compressed gas at the same time. The cylinder chambers 12 with the maximum volume is over the exhaust ports 3 and the expanded gas is exhausted at the same time. The double engines may be modified wherein one of the engines may be rotated so that the intake port 2 at a different location such as being rotated 90 degrees clockwise and the second engine has a minimum volume at 90 degrees. The rotated second engine power stroke would start when the first engine's power stroke was half way finished.

Operation

The one cylinder chamber compressed gas rotary engine of FIGS. 1, 2 and 3 operates with the rotor 4 rotating in the clockwise direction and starting from the position of the rotor 4 and piston 5 illustrated in FIG. 1 is in a position wherein the cylinder chamber is at its minimum volume, then the shaft 11 and rotor 4 with its piston 5 are rotated clockwise 180 degrees by means of compressed gas through compressed air intake port 2 into the compressed gas expansion stroke and then rotates 180 degrees thru the exhaust stroke to push out the remaining gas thru the exhaust ports in the housing 1 and rotates back to the compressed gas intake port. The rotor 4 is attached to the shaft 11 by means of a rotor stationary attachment 26 and rotates in the stationary housing 1 by means of compressed gas which enters the compression gas intake port 2 thereby putting pressure against the piston 5 in the rotor 4 which expands the cylinder's expansion space thereby putting a force against the round stationary eccentric cam 10 by means of a bearing 6 which is attached to the piston rod 31 and this force creates a rotary motion on the rotor 4 and shaft 11. The piston's 5 bearing 6 is guided around the stationary cam 10 by means of a piston guide 7 on the lower end of the piston rod 31 and two groves in the bottom of the piston 7 straddle the shaft in front and in back thereby preventing the piston from rotating. The rotor 4 with the piston 5 acts as a fly wheel. FIG. 3 illustrates using a timing pulley 25 containing a magnet attached to the front of the shaft 11, a magnet pick-up waves which controls the magnet valve 18 opening and the duration that it stays open also there is a pressure regulator 19 to adjust the compressed gas pressure. The compressed gas is confined to the cylinder chamber (expansion chamber) 12 by means of seals 8 on the rotor 4 and rings 9 on the piston. The compressed gas valve 17 may also be controlled by means of a mechanical gas valve, electronic controlled gas valve or by means of confining the pressured gas in the area of the cylinder chamber 12 by means of seals 8 on the rotor and rings on the piston. The moving parts in this compressed gas rotary engine is lubricated by means of lubricant in the central chamber 32 and by means of lubricant passages 13 to the moving parts.

FIGS. 4, 5 and 6 are plan views of a two piston compressed gas rotary engine which functions similar to the compressed gas rotary engine of FIGS. 1, 2 and 3. FIG. 3 which is a plan cross sectional view of the compressed air rotary engine of this invention containing two cylinder chambers 12 with 2 pistons 5 and when the upper piston cylinder 12 is at it minimum volume and is under the compressed gas intake 2 the second cylinder chamber 12 volume is at it maximum and the expanded gas is being exhausted thru the exhaust port 3. When the cylinder volume is at its minimum and the piston is under the compressed gas intake 3 compressed gas enters pressure regulator 19 then passes thru the timed air valve 26, which is attached to the anterior portion of the shaft, into the cylinder chamber 12 thereby putting a pressure on the top of the piston 5 which pushes against the piston bearing 6 which pushes against the round stationary cam 10 thereby producing a rotary force on the rotor 4 which contains the pistons 5 in the cylinder chamber 12 and the rotor 4 is attached to the shaft 11 which rotates with the rotor 4 inside the housing 1 and the shaft 11 and rotor 4 is rotated 180 degrees then rotated pass the exhaust port exhausting the expanded gas and the chamber volume is decreased to its minimum volume by the means of the eccentric stationary cam 10 creating a force on the piston's bearing 6 as it rotates 180 degrees back to under the compressed gas intake port. The shaft 11 extends thru the posterior wall 21 and anterior wall 22 of this compressed air rotary engine. As the rotor 4 rotates the gas in the second cylinder chamber 12 is exhausted thru the exhaust ports 3 and the cylinder chamber's volume is minimized by means of the stationary cam 10 which by its shape pushes the against the piston's bearing 6 forcing the piston toward the housing 1 thereby reducing expansion chamber 12 which is under the compressed gas intake and compressed air enters the cylinder chamber 12 and another rotation starts. The first cylinder 12 is rotated by the rotary force of the second piston and exhausts the spent gas in the cylinder while turning another 180 degree to where it is under the compressed gas intake port 2 and the air control valve 17 is opened and the compressed gas enters the cylinder chamber 12 starting another revolution cycle.

FIGS. 7, 8 and 9 are plan views of a 4 cylinder compressed gas rotary engine of this invention is powered by compressed gas and the cylinder chamber 12 with the minimum volume is under the compressed gas intake port, the next cylinder chamber 12 which is at 90 degrees from the cylinder chamber 12 with the minimum volume has a cylinder volume of 50% more then the minimum volume the next cylinder chamber which is 180 degrees from the minimum volume cylinder chamber 12 contains the maximum volume and the next cylinder chamber which is 270 degrees from the minimum volume cylinder chamber 12 has a cylinder chamber 12 volume of 50% more than the minimum volume cylinder chamber 12. The rotor 4 and shaft 11 rotates in the stationary housing 1 by means of compressed gas that passed thru a pressure regulator into a controlled gas valve and enters the cylinder chamber 12 with the minimum volume. This pressured gas in the cylinder chamber 12 puts a pressure force on the piston 5 and the piston bearing 6 which pushes against the stationary cam 10 creating a rotary force on the rotor 4 which is attached to the shaft 11 which rotates 180 degrees and the expanded gas is exhausted thru the exhaust ports 3 and the cylinder chamber volume is decreased by means of the piston bearing 6 against and rotating around the stationary eccentric round cam 10 and by expanding gas in another cylinder chamber 12 and centrifugal force. When the rotor rotates 90 degree another cylinder chamber 12 with a minimum volume is rotated to under the compressed gas intake port 2 and the air valve 19 is opened and the compressed air enters the cylinder chamber 12 thereby putting a pressure force on the piston 5 and the piston's bearing 6 which pushes against the stationary cam 10 creating a rotary force on the rotor 4 which rotates the rotor 4 and shaft 11 for 180 degrees then the expanded gas exhausted thru the exhaust ports 3. The cylinder with the expanded gas is further rotated by the force of expanding gas in the other two cylinder chambers 12 and the cylinder chamber's 12 volume is decreasing in the other two cylinder chambers 12 which is produced by the force of the piston's bearing against the eccentric round stationary cam 10 thereby forcing out the expanded gas thru the exhaust ports 3. There are 4 compressed gas power stroke per revolution of the rotor 4.

FIG. 23 is a plan sectional view of a double compressed gas rotary engine wherein each engine contains two cylinder chambers 12 which has the same parts and function the same at the same time. Both engines cylinder chambers with the minimum cylinder chamber 12 volume are under the compressed gas intake 2 and both cylinder chambers are filled with compressed gas at the same time. The engine's cylinder chamber 12 with the maximum volume is under the exhaust port 3 and is exhausting the expanded gas at the same time. Both engines function the same as the compressed gas rotary engine in FIGS. 4,5 and 6. This double engine may be modified wherein one of the engine may be rotated so that the intake port 3 with the minimum volume cylinder chamber 12 under it may be located different from the other engine such as being rotated 90 degree clockwise then the rotated engine's power stroke starts when the other engine's compressed gas in the power stroke has increased in volume by 50% and rotated 90 degrees. Two compressed gas rotary engine may just be attached together by means of connecting the shafts 11 together.

It will be understood that various changes and modifications may be made in the constructions described which provide the characteristics of this invention without departing from the spirit thereof particularly as defined in the following Claims.

I claim:

1. A compressed gas rotary engine with piston comprising, a housing formed with a peripheral wall which contains a cylindrical inner wall attached to side walls at 90 degrees, inner surface of said housing's peripheral wall being cylindrical, a cylindrical rotor, rotatable mounted in said housing and having a circular peripheral wall, side walls at 90 degrees to said peripheral rotor wall, with one side wall having means to be attached to an engine's shaft which protrude through the center of the said housing side walls and the other said side wall having a central opening, and one or more circular cylinder chambers extending from the said rotor's peripheral wall to the central chamber of said rotor, said rotor having means to seal one said cylinder chamber from the other cylinder chambers and the said central chamber, piston with piston rods for each said chamber, said piston rod contain a bearing, said pistons reciprocally mounted and forming variable volume in said cylinder chamber and has means to seal the cylinder chamber from the central chamber of said rotor, means to guide the reciprocal motion of said piston and means to rotate the rotor, said housing being provided with means admitting a compressed gas by means of a gas valve communicating with said cylinder chambers, means discharging expanded gas communicating with said cylinder chambers, means to guide the said rotor's motions in said housing, said cylinder chambers of varying sizes enabling an expansion of compressed gas to take place and expansion of said chambers due to the pressure of said compressed gas.

2. The compressed gas rotary engine according to claim 1 wherein the peripheral wall of said housing is provided with exhaust ports extending there through and the cylindrical inner wall of said housing is provided with intake port extending there through, said port being adapted to be opened or closed by during rotation by said gas valve and constituting said means for admission of compressed gas and means for discharging the expanded gas.

3. The compressed gas rotary engine according to claim 1, wherein the peripheral wall of said housing is provided with exhaust ports extending there through and is provided with intake port extending there through, said ports being adapted to be opened or closed by said rotor during rotation and constituting said means for admission of compressed gas and means for discharging the expanded gas.

4. The compressed gas rotary engine according to claim 1, wherein said piston guide plates is attached to said piston rod and located on both sides of the cam and the piston has grooves in the piston's bottom edge to fit over the said shaft to guide the piston's reciprocal motions and rotor's motion.

5. The compressed gas rotary engine according to claim 1, wherein the compressed gas intake is controlled by rotation of said rotor by means of confining the compressed gas to the cylinder chamber under the said intake port by means of seals on the rotor.

6. The compressed gas rotary engine according to claim 1, wherein the compressed gas entering thru the said intake port is controlled by a mechanical air valve and a gas pressure regulator.

7. The compressed gas rotary engine according to claim 1, wherein the compressed gas entering thru the said intake port is controlled by a magnetic air valve and a gas pressure regulator.

8. The compressed gas rotary engine according to claim 1, wherein the compressed gas entering thru the said intake port is controlled by a computer controlled gas valve and a gas pressure regulator.

9. The compressed gas rotary engine according to claim 1, wherein the said compressed gas is compressed air.

10. A compressed gas rotary engine with pistons in the rotor having a cycle of expansion and exhaustion said engine comprising:

a) a housing formed with a peripheral wall with side walls, said peripheral inner wall being cylindrical, leaving space in said housing for a rotor to rotate and being provided with means for admitting compressed gas communicating with cylinder chambers in the said rotor, means for discharging expanded gas communicating with said cylinder chambers:

b) a Rotor with a circular peripheral wall with side walls, central chamber, said cylinder chamber or chambers which are cylindrical and extended from the peripheral wall of the rotor to the rotor's said central chamber, one side wall of said rotor has means to attach to the engine shaft and the other side wall has a centrally located opening into said central chamber, the peripheral wall and side walls of said rotor has seals to seal against the housing peripheral wall and side walls, to seal off the said cylinder chamber from other cylinder chambers and from the said central chamber, said rotor being rotary mounted in said housing and attached to the engine shaft:

c) piston with a piston rod, mounted in the said cylinder chambers, having rings to seal the said cylinder chamber from the said central chamber and means for the said piston rod to push on the stationary cam to rotate the said rotor;

d) piston guide plates on the end of the piston rod and guiding notches in the piston wall has means to guide the reciprocal motions of the said piston to prevent rotation of said piston:

e) cam with stationary attachment to the said housing has means by the circular shape of said cam to guide the reciprocal motions of said piston and varying the volume of the cylinder chamber enabling an expansion stroke of the compressed gas and an exhausting stroke of the expanded gas.

11. The compressed gas rotary engine with pistons of claim 1 wherein two or more of the compressed gas rotary engines are attached together.

12. The compressed gas rotary engine with pistons of claim 10 wherein the compressed gas is compressed air.

13. The compressed gas rotary engine with pistons of claim 10 wherein two or more of the engines of claim 10 are attached together.

14. The compressed gas rotary engine with pistons of claim 10 wherein the compressed gas pressure is regulated by a pressure regular.

15. The compressed gas rotary engine with pistons of claim 10 wherein the compressed gas entering the intake port is controlled by a gas valve selected from the group consisting of a mechanically controlled valve, magnetic controlled valve or an electronically controlled valve.

16. The compressed gas rotary engine with pistons of claim 10 wherein the compressed gas entering the intake port is restricted to the cylinder chamber by means of seals on the rotor and the amount of time the pressured gas flows into the cylinder chamber is controlled by rotation of the rotor.

17. The compressed gas rotary engine with pistons of claim 14 wherein the compressed gas is supplied to the gas pressure regulator by means of a high pressure gas line from a pressurized tank.

18. The compressed gas rotary engine with pistons of claim 10 wherein the starting means is compressed gas.

* * * * *